US008978385B2

(12) United States Patent
Cunha

(10) Patent No.: US 8,978,385 B2
(45) Date of Patent: Mar. 17, 2015

(54) DISTRIBUTED COOLING FOR GAS TURBINE ENGINE COMBUSTOR

(75) Inventor: Frank J. Cunha, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 899 days.

(21) Appl. No.: 13/193,686

(22) Filed: Jul. 29, 2011

(65) Prior Publication Data

US 2013/0025287 A1 Jan. 31, 2013

(51) Int. Cl.

| | |
|---|---|
| ***F02C 1/00*** | (2006.01) |
| ***F02G 3/00*** | (2006.01) |
| ***F23R 3/00*** | (2006.01) |
| ***F23R 3/06*** | (2006.01) |

(52) U.S. Cl.

CPC . *F23R 3/002* (2013.01); *F23R 3/06* (2013.01); *F23R 2900/03042* (2013.01); *F23R 2900/03043* (2013.01); *F23R 2900/03044* (2013.01); *F23R 2900/03045* (2013.01)

USPC ..... 60/752; 60/755

(58) Field of Classification Search

USPC ..... 60/752–760, 772

See application file for complete search history.

(56) References Cited

U.S. PATENT DOCUMENTS

| | | | | |
|---|---|---|---|---|
| 5,421,158 | A * | 6/1995 | Stenger et al. | 60/747 |
| 5,687,572 | A * | 11/1997 | Schrantz et al. | 60/753 |
| 5,737,922 | A | 4/1998 | Schoenman et al. | |
| 5,782,294 | A * | 7/1998 | Froemming et al. | 165/168 |
| 6,402,470 | B1 * | 6/2002 | Kvasnak et al. | 416/97 R |
| 6,705,831 | B2 | 3/2004 | Draper | |
| 6,896,487 | B2 * | 5/2005 | Cunha et al. | 416/97 R |
| 7,137,776 | B2 | 11/2006 | Draper et al. | |
| 7,775,053 | B2 | 8/2010 | Joe et al. | |
| 2003/0213250 | A1 * | 11/2003 | Pacheco-Tougas et al. | 60/752 |
| 2005/0087319 | A1 * | 4/2005 | Beals et al. | 164/45 |

* cited by examiner

*Primary Examiner* — Gerald L Sung
*Assistant Examiner* — Scott Walthour
(74) *Attorney, Agent, or Firm* — Carlson, Gaskey & Olds, P.C.

(57) ABSTRACT

A combustor component of a gas turbine engine includes a refractory metal core (RMC) microcircuit for self-regulating a cooling flow.

18 Claims, 7 Drawing Sheets

DISTRIBUTED COOLING FOR GAS TURBINE ENGINE COMBUSTOR

BACKGROUND

The present disclosure relates to a combustor, and more particularly to a cooling arrangement therefor.

Gas turbine combustors have evolved to full hoop shells with attached heat shield combustor liner panels. The liner panels may have relatively low durability due to local hot spots that may cause high stress and cracking. Hot spots are conventionally combated with additional cooling air, however, this may have a potential negative effect on combustor emissions, pattern factor, and profile.

Current combustor field distresses indicate hot spots at junctions and lips. Hot spots may occur at front heat shield panels and, in some instances, field distress propagates downstream towards the front liner panels. The distress may be accentuated in local regions where dedicated cooling is restricted due to space limitations. Hot spots may also appear in regions downstream of diffusion quench holes. In general, although effective, a typical combustor chamber environment includes large temperature gradients at different planes distributed axially throughout the combustor chamber.

SUMMARY

A combustor component of a gas turbine engine according to an exemplary aspect of the present disclosure includes a liner panel with a refractory metal core (RMC) microcircuit.

A method of cooling a combustor of a gas turbine engine according to an exemplary aspect of the present disclosure includes self regulating a cooling flow through a refractory metal core (RMC) microcircuit within a heat shield.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
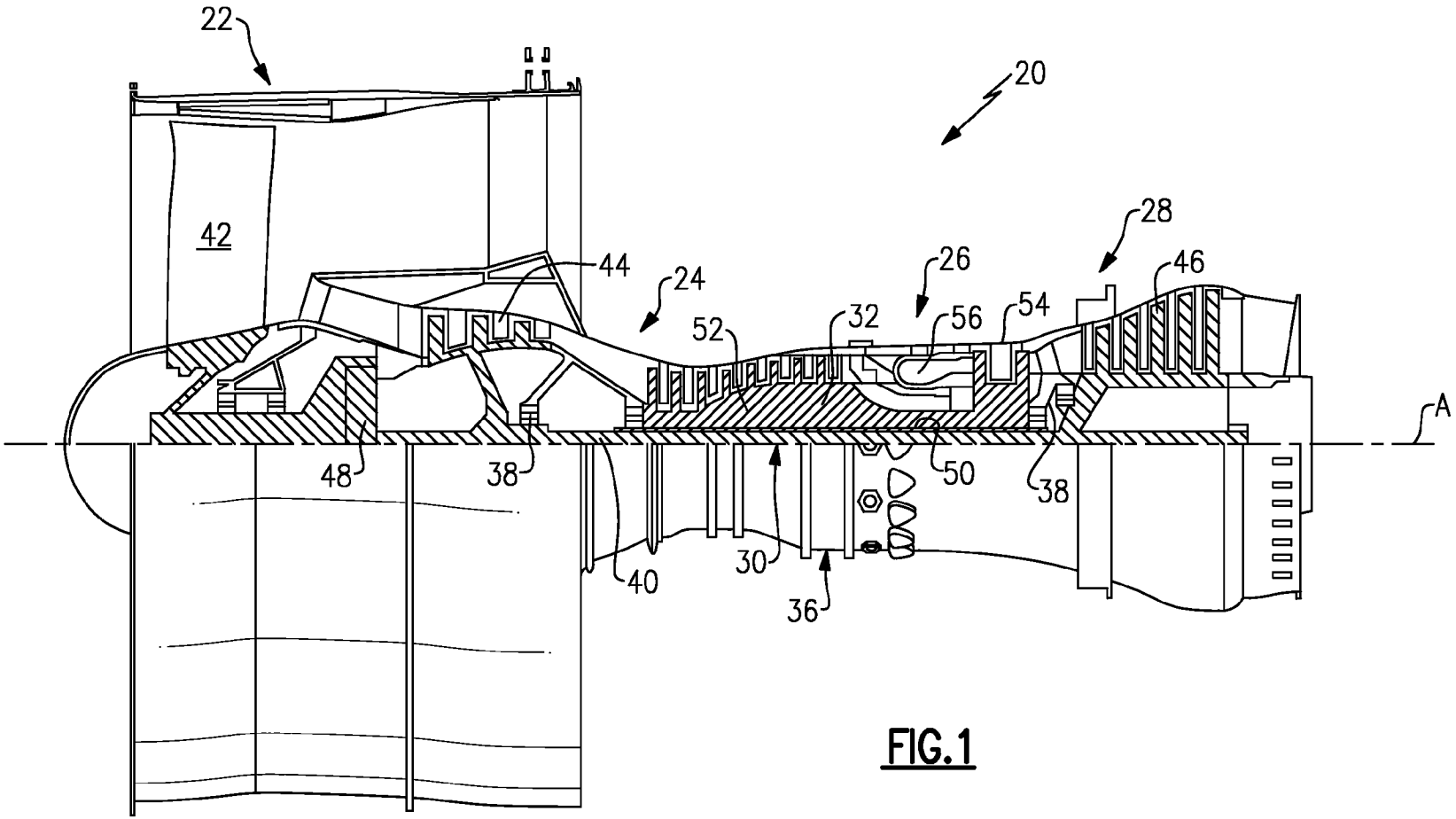
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

The core airflow is compressed by the low pressure compressor 44 then the high pressure compressor 52, mixed and burned with fuel within the combustor 56, then expanded over the high pressure turbine 54 and low pressure turbine 46. The turbines 54, 46 rotationally drive the respective low speed spool 30 and high speed spool 32 in response to the expansion.

Figure 2:
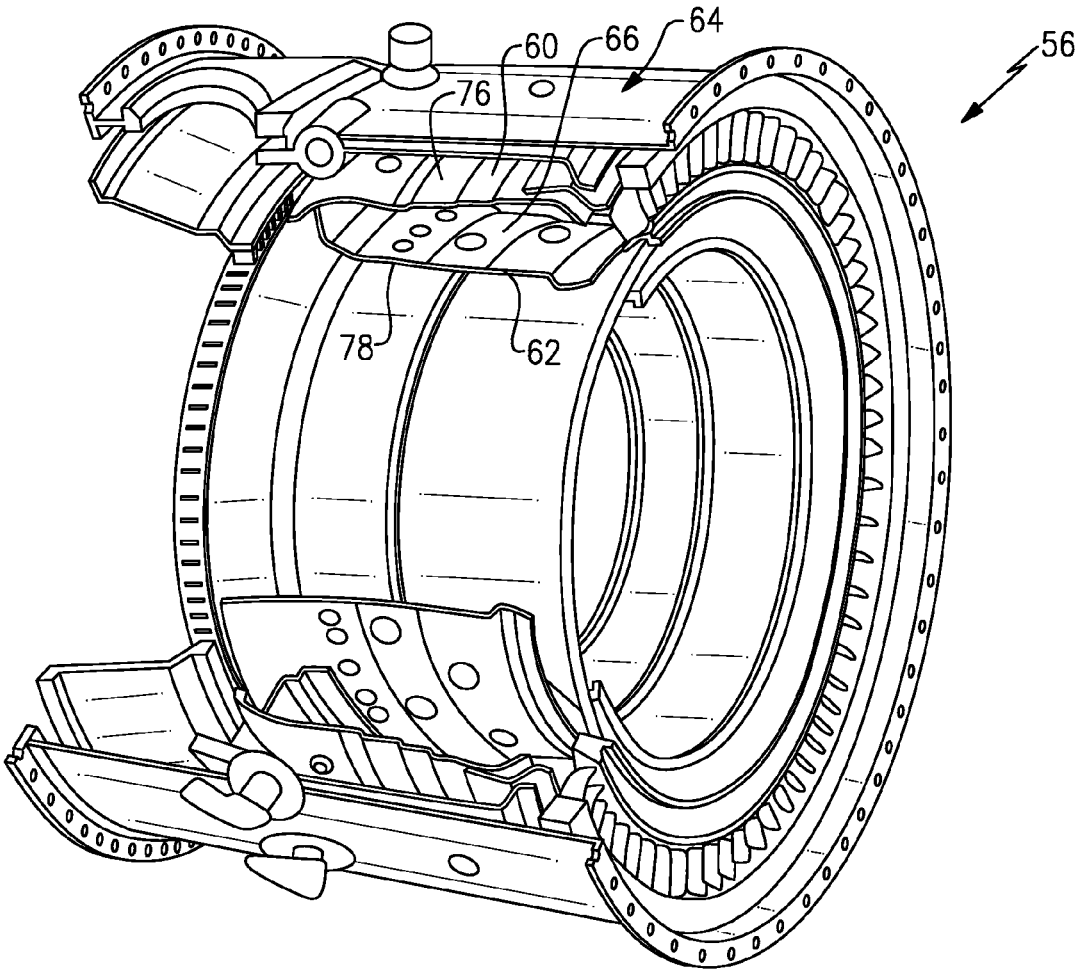
FIG. 2 is a perspective partial sectional view of an exemplary annular combustor that may be used with the gas turbine engine shown in FIG. 1.

With reference to FIG. 2, the combustor 56 generally includes an outer combustor liner 60 and an inner combustor liner 62. The outer combustor liner 60 and the inner combustor liner 62 are spaced inward from a combustor case 64 such that a combustion chamber 66 is defined there between. The combustion chamber 66 is generally annular in shape and is defined between combustor liners 60, 62.

The outer combustor liner 60 and the combustor case 64 define an outer annular passageway 76. The inner combustor liner 62 and the combustor case 64 define an inner annular passageway 78. It should be understood that although a particular combustor is illustrated, other combustor types with various combustor liner panel arrangements will also benefit herefrom. It should be further understood that the disclosed cooling flow paths are but an illustrated embodiment and should not be limited only thereto.

Figure 3:
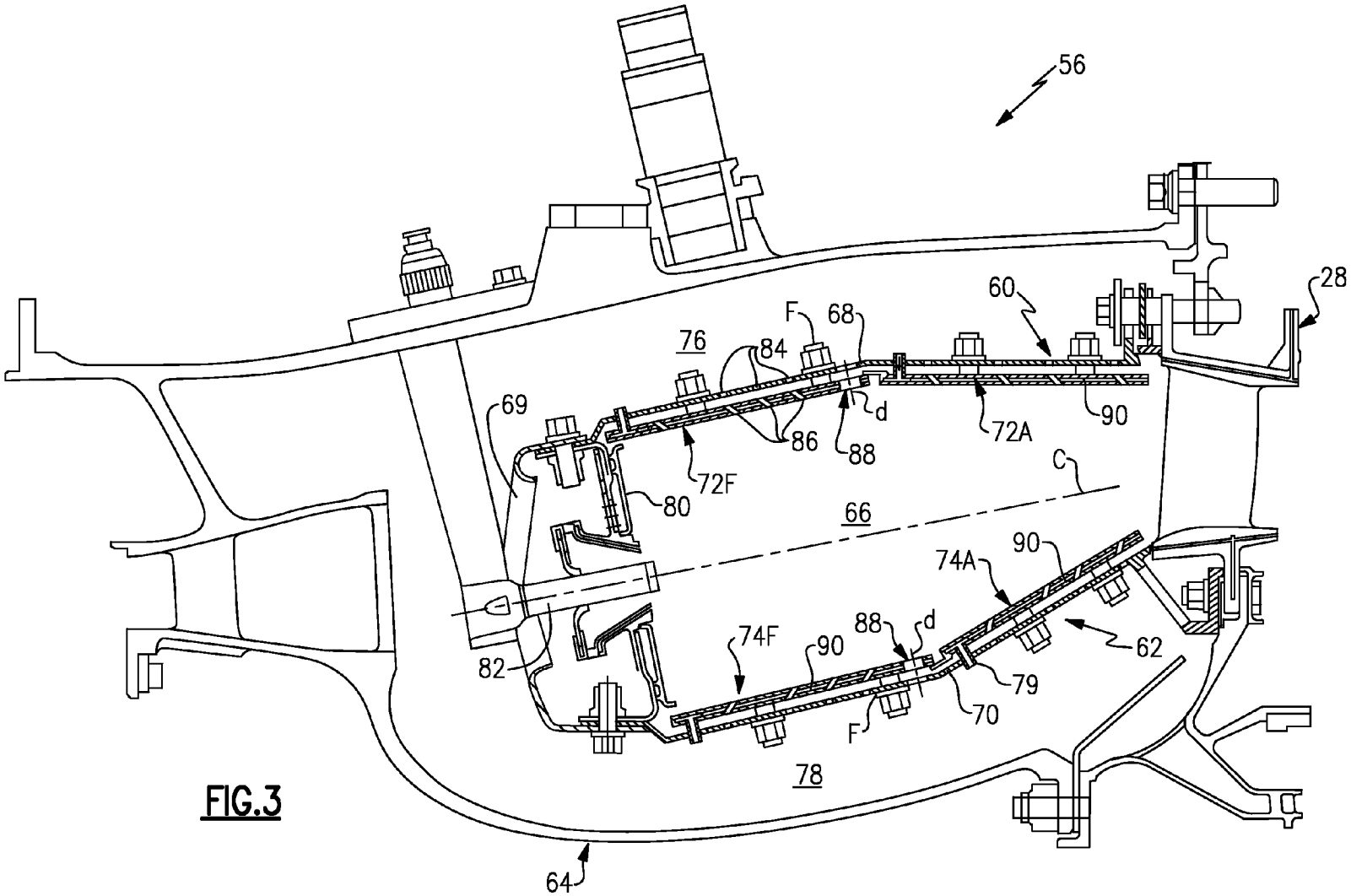
FIG. 3 is a cross-sectional view of an exemplary combustor that may be used with the gas turbine engine.

With reference to FIG. 3, the combustor liners 60, 62 contain the flame for direction toward the turbine section 28. Each combustor liner 60, 62 generally includes a support shell 68, 70 which supports one or more liner panels 72, 74 mounted to a hot side of the respective support shell 68, 70. The liner panels 72, 74 define a liner panel array which may be generally annular in shape. Each of the liner panels 72, 74 may be generally rectilinear and manufactured of, for example, a nickel based super alloy or ceramic material.

In the disclosed non-limiting embodiment, the combustor 56 includes a plurality of liner panels 72, 74 arranged about a combustor axis C to define an array. A plurality of forward liner panels 72F and aft liner panels 72A line the hot side of the outer shell 68, and forward liner panels 74F and aft liner panels 74A line the hot side of the inner shell 70. Fastener assemblies F such as studs and nuts may be used to connect each of the liner panels 72, 74 to the respective inner and outer shells 68, 70 to provide a floatwall type array. It should be understood that various numbers, types, and array arrangements of liner panels may alternatively or additionally be provided.

The combustor 56 may also include heat shield panels 80 that are radially arranged and generally transverse to the liner panels 72, 74. Each heat shield panel 80 surrounds a fuel injector 82 which is mounted within a dome 69 which connects the respective inner and outer support shells 68, 70.

A cooling arrangement disclosed herein may generally include a multiple of impingement cooling holes 84, film cooling holes 86, dilution holes 88 and refractory metal core (RMC) microcircuits 90 (illustrated schematically). The impingement cooling holes 84 penetrate through the inner and outer support shells 68, 70 to communicate coolant, such as a secondary cooling air, into the space between the inner and outer support shells 68, 70 and the respective liner panels 72, 74 to provide backside cooling thereof. The film cooling holes 86 penetrate each of the liner panels 72, 74 to promote the formation of a film of cooling air for effusion cooling. The dilution holes 88 penetrate both the inner and outer support shells 68, 70 and the respective liner panels 72, 74 along a common dilution hole axis d to inject dilution air which facilitates combustion and release additional energy from the fuel.

Figure 4:
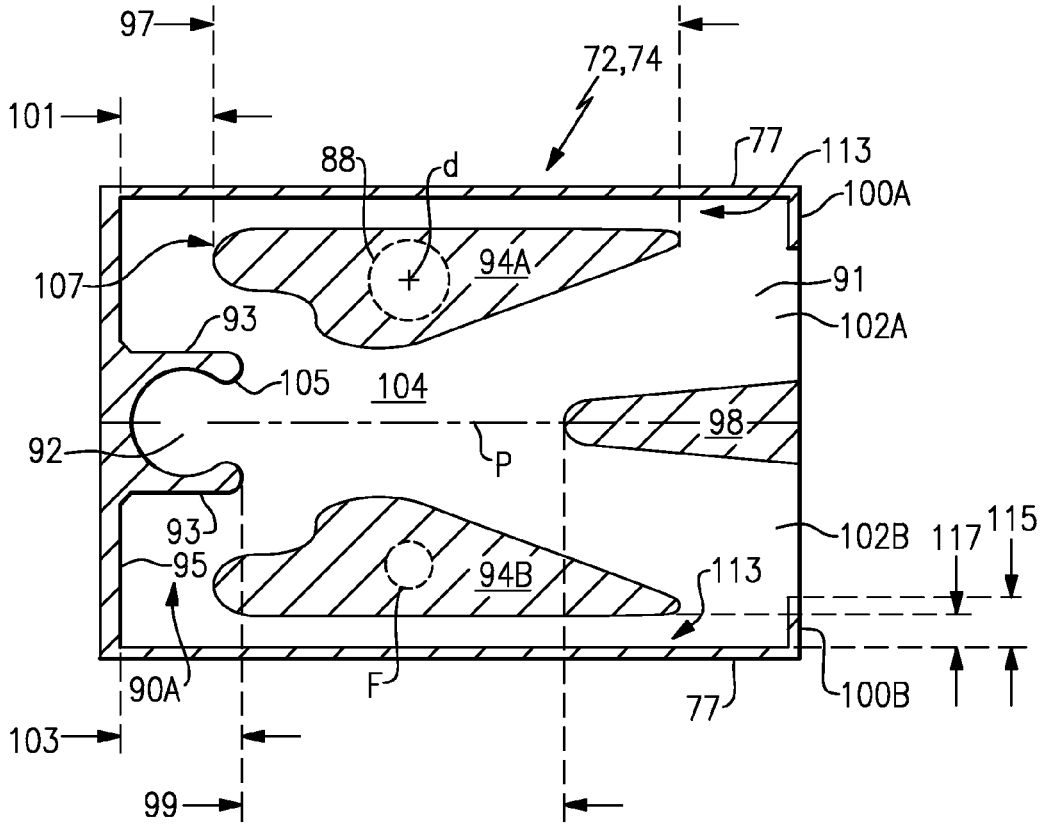
FIG. 4 is an expanded plan view of a microcircuit.
Figure 5:
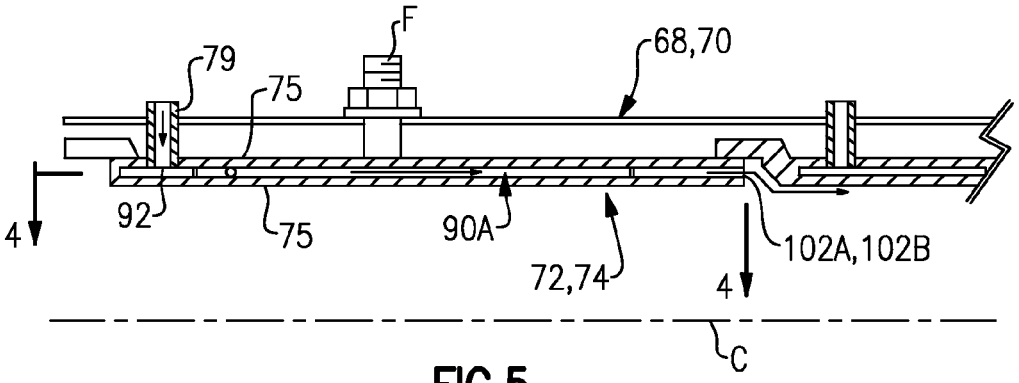
FIG. 5 is an expanded cross-sectional view of the microcircuit of FIG. 5.

Referring to FIGS. 3-5, the RMC microcircuits 90 may be selectively formed within the liner panels 72, 74 through a refractory metal core process. Refractory metal cores (RMCs) are typically metal-based casting cores usually composed of molybdenum with a protective coating. The refractory metal provides more ductility than conventional ceramic core materials while the coating—usually ceramic - protects the refractory metal from oxidation during a shell fire step of the investment casting process and prevents dissolution of the core from molten metal. The refractory metal core process allows small features to be cast inside internal passages. This, in turn, allows advanced cooling concepts, through the design space with relatively lower cooling flows as compared to current technology cooling flow levels.

RMC technology facilitates the manufacture of very small cast features such that the cooling supply flow may be minimized. As the cooling supply flow decreases, it may be beneficial to minimize any flow arrangement that may not operate at the highest level of optimization. Therefore, the design of the RMC microcircuit may beneficially optimize flow distribution by sensing external operating conditions.

With reference to FIG. 4, an RMC microcircuit 90A according to one non-limiting embodiment is formed within the liner panel 72, 74. In the disclosed non-limiting embodiment, the height (FIG. 5) of the RMC microcircuit 90A may be in the range of 0.012-0.025 inches (0.030-0.064 cm) for each location within each liner panel 72, 74. That is, the liner panel 72, 74 includes the disclosed internal features which are formed via RMC technology. It should be understood that various heights may alternatively or additionally be provided.

Referring to FIGS. 4 and 5, the RMC microcircuit 90A includes a multiple of internal features located within the generally rectilinear liner panel 72, 74. The internal features extend radially between liner sections 75. The internal features may generally include a semi-circular inlet 92, a first divergent island 94A, a second divergent island 94B, a flow separator island 98, a first feedback feature 100A, a second feedback feature 100B, a first slot exit 102A and a second slot exit 102B (also shown in FIG. 5). The feedback features 100A, 100B extend from walls 77 that bound the secondary flow. In some examples, the exit slots 102A, 102B can be arranged coaxially with an adjacent liner panel 72, 74 (shown in FIG. 5). The internal features include an inlet wall 93 having a semi-circular geometry extending from a first wall 95 of the liner panel 72, 74 to provide the inlet 92. An access port 79 (shown in FIG. 5) extends from the liner panel 75 to communicate flow between the inner and outer annular passageways 76. 78 and the inlet 92, As shown, the access port 79 extends through the support shell 68, 70. The inlet wall 93 bounds the inlet 92 to direct flow between the inner and outer annular passageways 76, 78 and a main flow path or cooling channel 104. Generally, the first divergent island 94A, the second divergent island 94B, the flow separator island 98, the first feedback feature 100A, and the—second feedback feature 100B are structures formed by the RMC microcircuit 90A which guide and direct the secondary flow as described herein within the cooling channel 104 formed within the liner panel 72, 74. That is, the structures form flows such as a self-regulating feedback which is further describe herein below. The inlet 92, the first slot exit 102A and the second slot exit 102B provide communication into or out of the RMC microcircuit 90A. That is, the liner panel 72, 74, the inlet 92, the first slot exit 102A and the second slot exit 102B provide communication from within the liner panel 72, 74 to the combustor chamber 66.

In this non-limiting embodiment, the semi-circular inlet 92 and the flow separator island 98 are located along an axis P. In some examples, the inlet wall 93 is at least partially coaxial with the divergent islands 94A. 94B along the axis P. As shown in FIG. 4, the first and second divergent islands 94A, 94B extend a distance 97 along the axis P. and the inlet wall 93 and flow separator island are spaced apart a distance 99 along the axis P such that distance 97 is greater than distance 99. Also as shown in FIG. 4. the first and second divergent islands 94A, 94B are spaced a distance 101 from the first wall 95. which is less than a length 103 of the inlet wall 91 In this arrangement, an inlet port 105 defined by the inlet wall 93 extends downstream of a feedback outlet 107 provided by one the first and second divergent islands 94A, 94B with respect to the axis P. The first divergent island 94A may define a location for a dilution hole 88 which extends therethrough. The second divergent island 94B may define a mount for the fastener F which supports the liner panel 72, 74 (FIG. 5). It should be understood that other arrangements of internal features, fastener and hole locations may alternatively or additionally be provided.

Figure 6A:
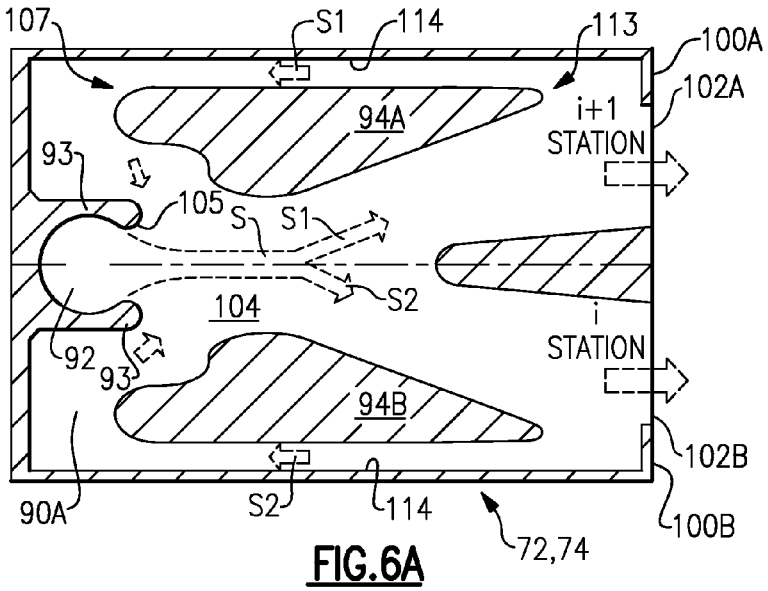
FIG. 6A is a plan view of a first flow condition within the liner panel.

With reference to FIG. 6A, a feedback feature 100A, 100B may be transverse and extend toward the axis P to facilitate generation of self-regulating feedback loops or flow paths S1, S2. The semi-circular inlet 92 forces the secondary cooling air S to spread into a cooling channel 104. The divergent islands 94A, 94B are configured to further spread the flow in the channel 104. As the cooling flow approaches slot exits 102A, 102B, the self-regulating feedback flow paths S1, S2 form loops around the respective divergent islands 94A, 94B. The first and second feedback loops S1, S2 each include a feedback passage 114 extending between the feedback outlet 107 and a feedback inlet 113 positioned downstream of the feedback outlet 107 (shown in FIGS. 4 and 6A). As shown, the feedback outlets and inlets 107. 113 are defined between the walls 77 and the divergent islands 94A, 94B. As shown in FIG. 4, each of the feedback features 100A, 100B extends radially inward a first distance 115 greater than a second distance 117 defined by each of the feedback inlets 113 to communicate flow from the channel 104 to each of the feedback inlets 113. The internal features adjust the internal cooling flow characteristics in response to an operating condition as represented graphically by flow distributions at stations (i) and (i+1).

Figure 7A:
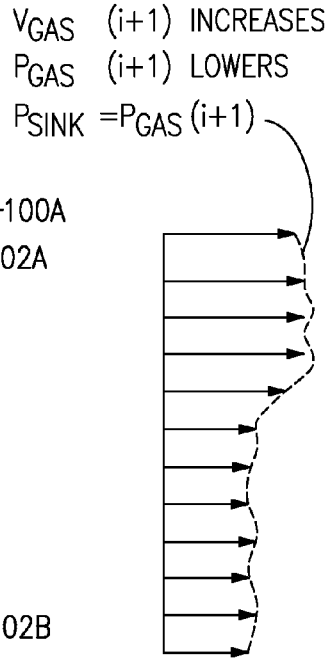
FIG. 7A is a first example flow distribution which is unbalanced.
Figure 6B:
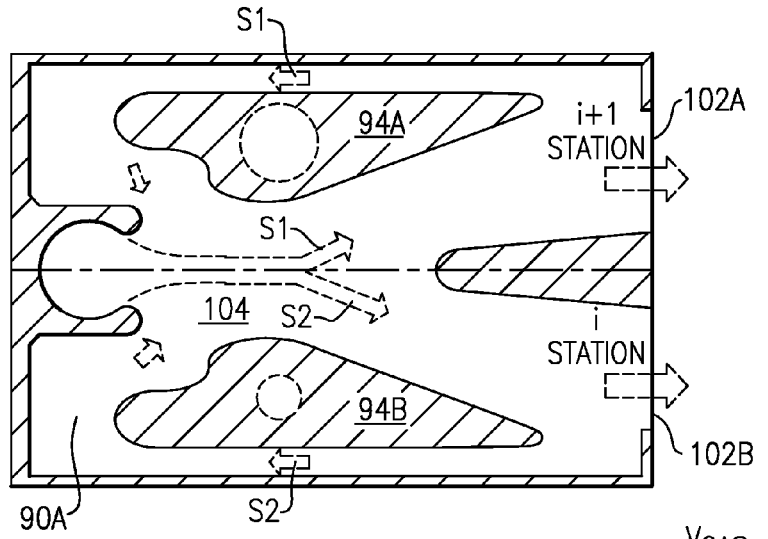
FIG. 6B is a plan view of a second flow condition within the liner panel.
Figure 7B:
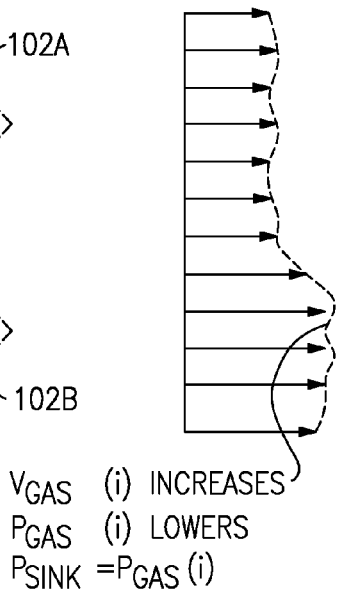
FIG. 7B is a second example flow distribution which is unbalanced and the reverse of FIG. 7A.
Figure 8:
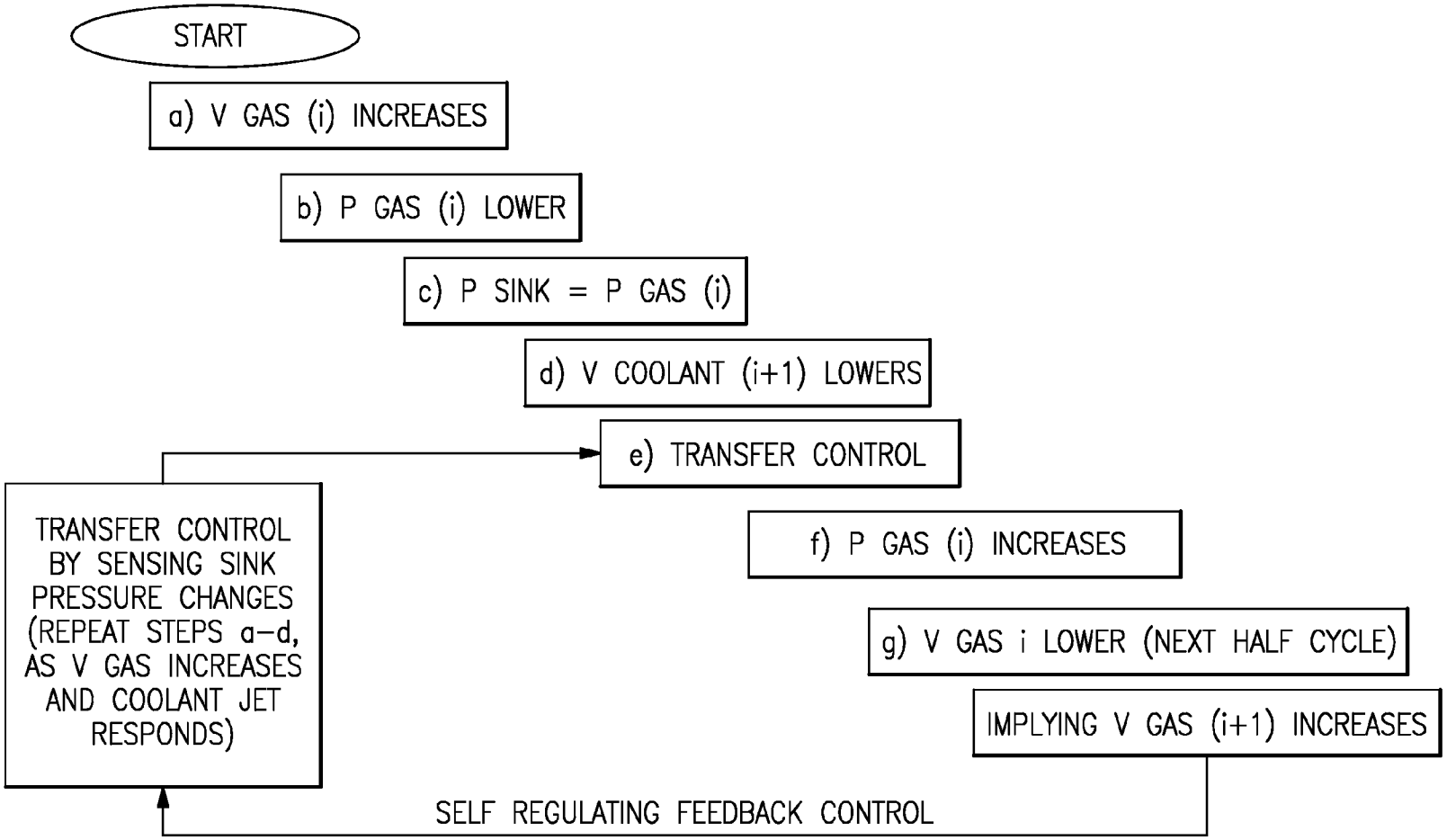
FIG. 8 is a flow chart of microcircuit operation.

If the secondary cooling air S flow velocity is uniform within the channel 104 formed by islands 94A, 94B, the self-regulating feedback flows S1, S2 are equivalent, and there is no preferred tendency for the flow of secondary cooling air S to move to either of the exit slots 102A, 102B. However, if the secondary cooling air S flow velocity is not uniform, an unbalance between the self-regulating feedback flows S1, S2 will be established to modulate the flow to the respective slot exits 102A, 102B (FIGS. 6A, 6B). In FIG. 6A, an example flow distribution (FIG. 7A) is illustrated when the secondary cooling air S flow velocities increase towards the slot exit 102A (station (i+1)). The reverse occurs in FIG. 6B as the main secondary cooling air S flow velocities increases towards the slot exit 102B (station (i)). This effect attenuates potential hot streaks in the main secondary cooling air S flow through increased film cooling where required (FIG. 7B). That is, the self regulating feedback flows S1, S2 sense the effects of the sink pressure changes and influences flow of the main secondary cooling air S distribution to address the fluctuations and balance in a self-regulating manner (FIG. 8). The transfer of flow control is derived from sensing the sink pressure variations at the microcircuit exit. The flow rate within the microcircuit is inversely proportional to the sink pressure variations. As a result, the feedback flow returns to the beginning of the circuit, which then directs the main flow to the flow branch whose exit has a relative higher sink pressure. This provides a self-regulating action in the circuit without any moving parts.

Figure 9:
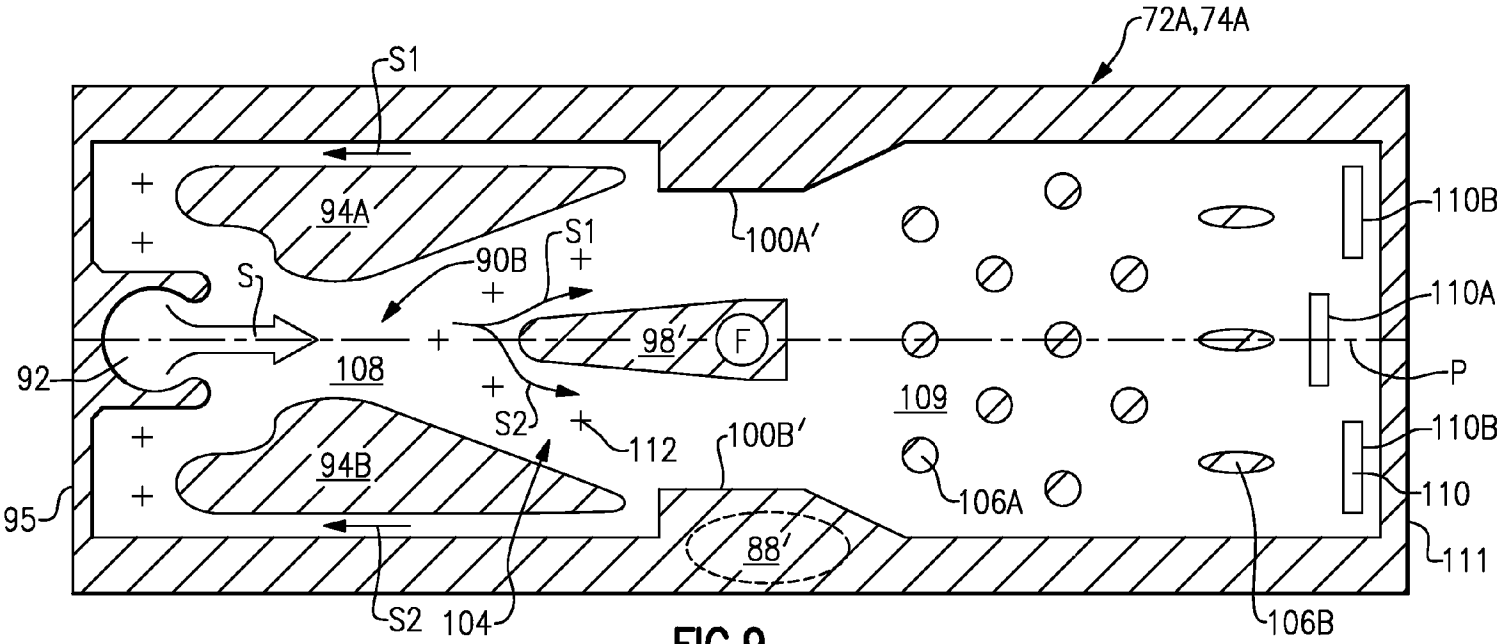
FIG. 9 is a planar view of another microcircuit.

With reference to FIG. 9, an RMC microcircuit 90B according to another non- limiting embodiment, formed within the liner panel 72A, 74A supplements the internal features as discussed above. The microcircuit 90B includes a first region 108 and a second region 109 separated by a flow separator island 98'. An axis P extends between a first wall 95 and a second wall 111 of the liner panel 72, 74. Cooling enhancement features such as pedestals 106A, followed by flow straighteners 106B, are formed in the second region 109 and upstream of slot film cooling openings 110 (also shown in FIG. 9). As shown, the slot film cooling openings 110 include a first opening 110A located along the axis P and one or more second openings 110B offset from the axis P. These relatively small cooling enhancement features are structures formed within the second region 109 to further effect the flow and are readily manufactured through refractory metal core technology in a manner commensurate with the islands 94A, 94B. Additionally, a multiple of laser holes 112 (illustrated schematically) may be located at strategic locations ahead of relatively larger internal features.

Figure 10:
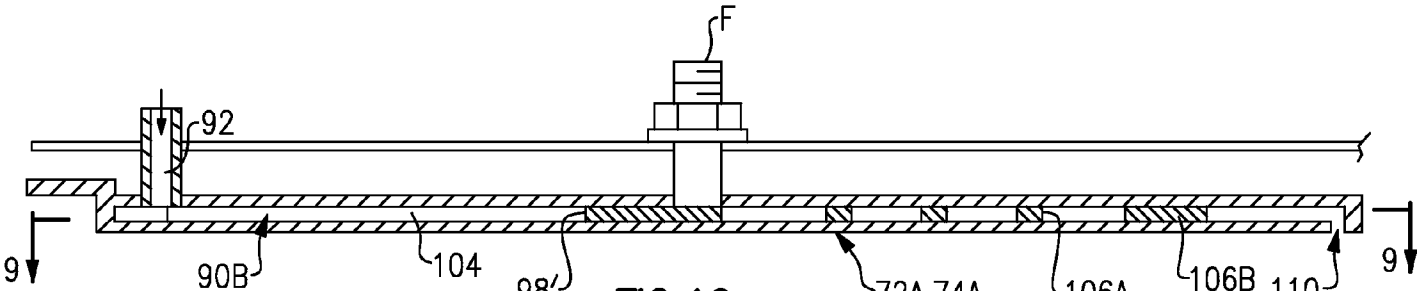
FIG. 10 is a sectional view of the microcircuit of FIG. 9.

In this non-limiting embodiment, the feedback features 100A', 100B' define a metering area between the internal features 94A, 94B and the cooling enhancement features 106A, 106B. The indented feedback features 100A', 100B' also provide a location for a dilution hole 88'. The flow separator island 98' may define a mount for the fastener F which supports the liner panel 72A, 74A (FIG. 10).

The RMC microcircuits 90 provide effective cooling to address gas temperature variations inside the combustor chamber; enhance cooling through flow distribution with heat transfer enhancement features while maintaining increased film coverage and effectiveness throughout the combustor chamber; improve combustor durability by optimum distribution of cooling circuits; and facilitate lower emissions and improved turbine durability.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A combustor component of a gas turbine engine comprising:

a liner panel defining a microcircuit provided with an inlet and at least two feedback outlets;

wherein said microcircuit includes a main flow path extending downstream from said inlet and a pair of feedback flow paths branching downstream from said main flow path and extending upstream of said main flow path at said inlet;

wherein said microcircuit is configured to flow a coolant therethrough and said inlet is configured to admit said coolant to flow therefrom downstream along said main flow path to said pair of feedback flow paths;

wherein said microcircuit is further configured to flow coolant upstream along said pair of feedback flow paths to said at least two feedback outlets upstream of said main flow path at said inlet; and wherein said microcircuit is further configured to flow coolant from said at least two feedback outlets to said main flow path.

2. The combustor component as recited in claim 1, wherein said liner panel is a generally planar forward liner panel.

3. The combustor component as recited in claim 1, wherein a semi-circular inlet wall separates said inlet from said pair of feedback flow paths.

4. The combustor component as recited in claim 1, wherein said liner panel includes a first divergent island and a second divergent island separating said main flow path from said pair of feedback flow paths.

5. The combustor component as recited in claim 4, further comprising a flow separator island defining a pair of flow channels and extending upstream between said first divergent island and said second divergent island.

6. The combustor component as recited in claim 5, wherein a semi-circular inlet wall bounding said inlet is located along an axis which intersects said flow separator island.

7. The combustor component as recited in claim 5, further comprising a dilution hole which penetrates through said second divergent island.

8. The combustor component as recited in claim 6, further comprising a plurality of cooling enhancement features positioned in said microcircuit downstream of said pair of flow channels and said flow separator island.

9. The combustor component as recited in claim 8, wherein said plurality of cooling enhancement features include pedestals.

10. The combustor component as recited in claim 8, wherein said plurality of cooling enhancement features include flow straighteners.

11. The combustor component as recited in claim 8, wherein said plurality of cooling enhancement features include laser holes.

12. The combustor component as recited in claim 8, wherein said liner panel defines a plurality of slot film cooling openings downstream of said flow separator island.

13. A combustor section for a gas turbine engine comprising:

a combustor liner including a plurality of liner panels arranged about an axis to define a combustion chamber;

a combustor case arranged with said combustor liner to define an annular passageway;

a support shell mounting at least one of said plurality of liner panels to said combustor case; and a cooling circuit within at least one of said plurality of liner panels, said cooling circuit including a main flow path extending from an inlet coupled to said annular passageway, said main flow path branching downstream at a pair of feedback flow paths, said pair of feedback flow paths extending upstream of said main flow path at said inlet and provided with a pair of feedback outlets upstream of said main flow path wherein an inlet wall separates said inlet from said pair of feedback flow paths; and wherein said cooling circuit is configured to flow a coolant therethrough and said inlet is configured to admit said coolant to flow therefrom downstream along said main flow path to said pair of feedback flow paths;

wherein said microcircuit is further configured to flow coolant upstream along said pair of feedback flow paths to said at least two feedback outlets upstream of said main flow path at said inlet; and wherein said microcircuit is further configured to flow coolant from said at least two feedback outlets to said main flow path.

14. The combustor section as recited in claim 13, wherein said inlet wall has a semi-circular geometry configured to direct coolant from said inlet to said main flow path and away from said pair of feedback flow paths upstream of said inlet.

15. The combustor section as recited in claim 13, comprising a flow separator island positioned within said main flow path to separate said pair of feedback flow paths and define a pair of flow channels.

16. The combustor section as recited in claim 15, comprising a pair of feedback features extending from a wall of said at least one of said plurality of liner panels and toward said flow separator island to further define said pair of flow channels and to bound said pair of feedback flow paths.

17. The combustor section as recited in claim 15, wherein a length defined between said inlet and said flow separator island is less than a length of each of said pair of feedback flow paths.

18. The combustor section as recited in claim 13, wherein said cooling circuit includes a first region and a second region separated by said flow separator island, said pair of feedback flow paths being located upstream of said second region, and said second region is provided with a plurality of openings to communicate coolant from said cooling circuit to said combustion chamber.

* * * * *